United States Patent [19]

Guerguerian

[11] 4,365,763

[45] Dec. 28, 1982

[54] DISCHARGE ZONE FASTENING ASSEMBLY FOR GRINDING MILL

[75] Inventor: Rhual L. Guerguerian, La Salle, Canada

[73] Assignee: Dominion Engineering Works Limited, Lachine, Canada

[21] Appl. No.: 189,173

[22] Filed: Sep. 22, 1980

[30] Foreign Application Priority Data

Oct. 26, 1979 [CA] Canada ..... 338548

[51] Int. Cl.[3] ..... B02C 17/18

[52] U.S. Cl. ..... 241/70; 241/171; 241/182

[58] Field of Search ..... 241/171, 181, 182, 183, 241/70

[56] References Cited

U.S. PATENT DOCUMENTS

| | | | |
|---|---|---|---|
| 1,139,651 | 5/1915 | Easton | 241/70 |
| 1,183,431 | 5/1916 | Carlson | 241/183 |
| 2,181,943 | 12/1939 | Kennedy | 241/70 |
| 3,599,882 | 8/1971 | Sabaski et al. | 241/70 |
| 3,604,637 | 9/1971 | Sabaski | 241/181 |
| 3,844,492 | 10/1974 | Smallwood et al. | 241/181 |

FOREIGN PATENT DOCUMENTS

| | | |
|---|---|---|
| 805655 | 2/1969 | Canada . |
| 927353 | 5/1973 | Canada . |
| 936849 | 11/1973 | Canada . |

*Primary Examiner*—John McQuade
*Attorney, Agent, or Firm*—R. A. Eckersley

[57] ABSTRACT

In a grinding mill hollow drum structure a novel fastening assembly is provided for securing a discharge lifter between grates and a discharge head portion of the drum structure. The fastening assembly includes a hollow cantilever post having a body and a securing stem portion, being threaded or under tension or conical or the like, that adjoins the body at one end thereof and is accessible from outside the structure to receive a nut for releasably securing and adjusting the post in fixed relation to the discharge head portion. The post, once secured, provides a transverse load bearing capability for supporting the lifter, the wear plates and grates. A retaining structure surrounds the body of the post and cooperates with the discharge lifter to secure the lifter to the body. An inner tensioning bolt having a fixed head is provided that extends through a hollow portion of the cantilever post having a securing nut that is accessible from outside the drum structure to hold the discharge grates or discharge wear plates in pressing relation against the discharge lifter, the bolt being inwardly releasable for withdrawal into the drum.

21 Claims, 9 Drawing Figures

FIG.1.
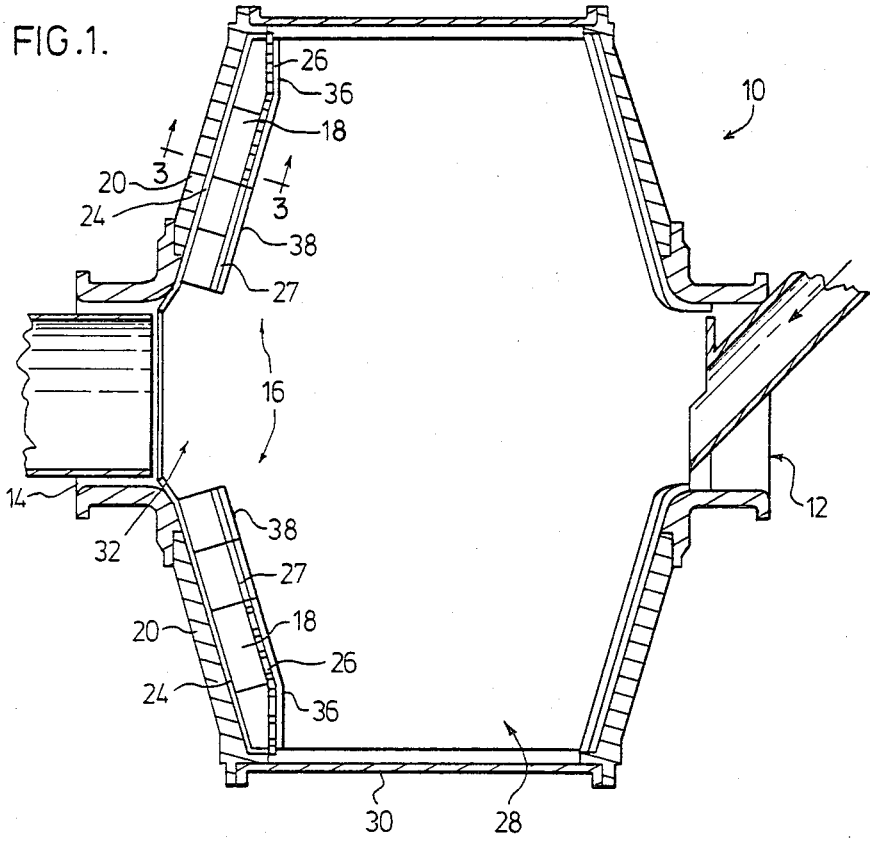
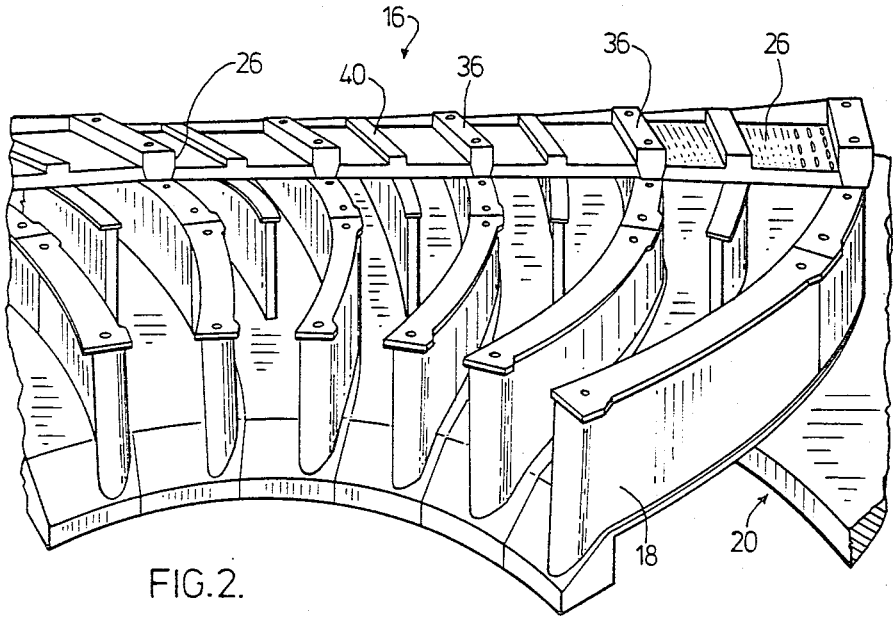
FIG.2.

FIG.6.
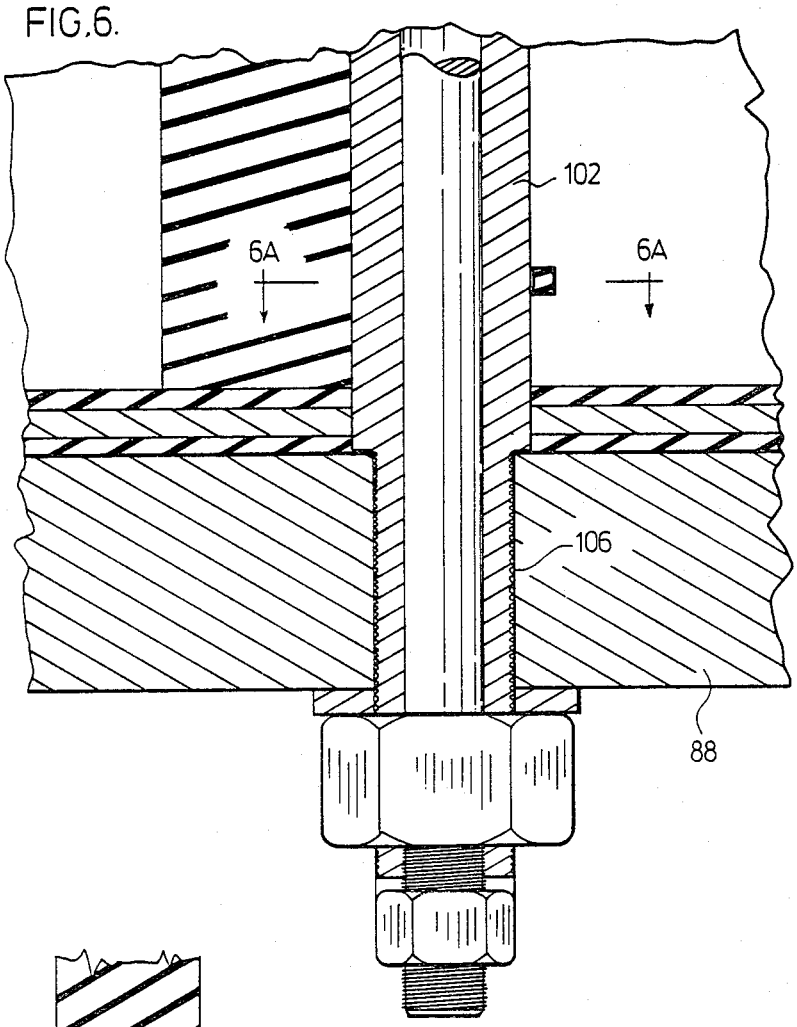
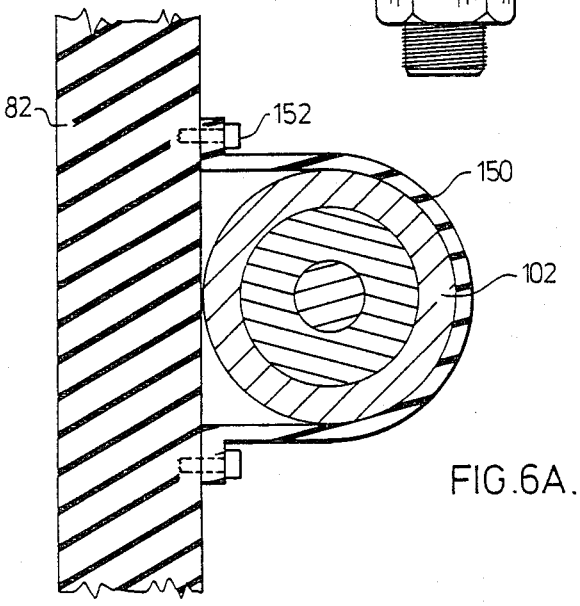
FIG.6A.

DISCHARGE ZONE FASTENING ASSEMBLY FOR GRINDING MILL

This invention relates to a grinding mill hollow drum structure having a fastening assembly and more particularly a discharge lifter fastening assembly.

Large grinding mill structures used for the reduction of friable material into ground material are known, having discharge lifters to elevate the ground material from the periphery of the mill drum structure to a point near the drum center, for discharge from the drum, by way of a discharge trunnion. The discharge lifters are located between a liner plate of the discharge head and grates which enclose the lifter zone and provide size-limited access to the zone, so that only suitably reduced material passes through the grates for elevation by the discharge lifters.

The prior art discharge lifters are secured in fixed relation between the grates and the liner plate of the discharge head, usually by way of a fastening assembly that includes a wedge and one or more tensioning bolts. The wedge has a recess therein for receiving the head portion of a tensioning bolt which passes therethrough, extending through the discharge lifter and through aligned apertures in the liner plate and the discharge head. The bolt is drawn towards the discharge head by tightening a nut on a threaded portion of the bolt that is accessible from outside the grinding mill structure. Tightening places each bolt under tension drawing the wedges toward the grates, which in turn forces the grates toward the discharge lifters, the discharge lifters towards the liner plate, and the liner plate toward the discharge head. The discharge lifter is usually a fabricated hollow box-like structure. The diameter of the aligned apertures are usually larger than that of the tensioning bolts. The length of the bolt should be minimized in order to place as much tension on the bolt as required to hold the wedges, grates, lifters, liner plate, and discharge head in their mutual pressing relations.

A disadvantage with this prior art fastening assembly is that, during the operation of the mill, transverse loading on the bolts has resulted in the bolts loosening. The loosening of the bolts occur despite the fact that the design tolerance between the difference, in the diameter of each bolt and that of the aligned apertures has been complied with. When the bolts loosen, the holes in the discharge box-like structure receiving the bolt, elongate to oval shapes and result in working of the grate sections which are displaced radially and which, in some instances, have permitted grinding balls of three inches in diameter to pass between the grated sections and to be discharged from the mill.

Another problem with the fastening means is that it does not lend itself readily to mill erection. Usually, the mill head structure is initially assembled horizontally on the floor of the manufacturing plant in stages for test purposes. The head structure is subsequently disassembled for transporting to the job site. At the job site the structure is re-assembled vertically and because of the weight of the discharge lifter, grates, and wedges or clamp bars it makes alignment for passing of the long tensioning bolt through the holes in each of these members quite difficult and somewhat dangerous; these holes being namely in the grate, the wedge or clamp bars, the close-end and the blind far end in the box-like structure and the hole in the conical grinding mill discharge head. Still yet another problem with the prior art arrangement is that bolts have a tendency to break shortly after abrasive materials wear through the lifter structure.

It is a feature of this invention to provide a discharge lifter fastening structure that is not as susceptible to transverse loading so as to be less likely to loosen during the operations of the mill structure.

Briefly, the present invention provides a novel fastening assembly for securing each discharge lifter to a discharge head portion of a grinding mill hollow drum structure. The fastening assembly comprises a rigid cantilever post means having a body portion and a securing stem portion, which may be threaded, under tension or conical, that adjoins the body portion at one end thereof and protrudes from the discharge head portion. The securing stem portion may carry a nut that is accessible from outside the drum structure, to releasably secure and adjust the cantilever post means in fixed relation to the discharge head portion, which provides the cantilever post means with a transverse load bearing capability for supporting a discharge lifter sections and wear plates or grates. The fastening assembly may further include a retaining means that is operable with the discharge lifter and the body portion of the post means to retain the discharge lifter in secured relation to the body portion.

It should be understood that the use of more than one cantilever post means is preferred for each discharge lifter. However, in some instances such as, for example, when curved discharge lifters or discharge channel members are in mutual triangulated relation only one cantilever post means per discharge channel member may be required. Also only one cantilever post means may be required to provide the load bearing capability feature and other fastening means may be used in conjunction therewith.

Therefore, in accordance with one aspect of the invention there is provided in a grinding mill hollow drum structure heaving a discharge head portion and a plurality of discharge channel members, a fastening assembly for securing each of the discharge channel members to the discharge head portion, comprising at least one rigid cantilever post means having a body portion and a securing stem portion that adjoins the body portion at one end thereof and is secured in fixed relation to the discharge head portion whereby the body portion provides a transverse load bearing capability for supporting the one discharge channel member.

Additionally, the fastening assembly further includes retaining means cooperating with the one discharge channel member and the body portion of the cantilever post means to retain the one discharge channel member in secured relation to the body portion.

Also, the cantilever post means may be hollow to permit an inner bolt means to be withdrawable therethrough. The inner bolt means may include a tensioning portion accessible from outside the drum structure for tensioning the inner bolt means to the grates or wear plates in mutual pressing relation with the one discharge lifter.

Therefore, in accordance with another aspect of the invention there is provided in a grinding mill hollow drum structure having a discharge head portion, a plurality of wear plates and grates, and a plurality of discharge channel members interpositioned between the discharge head portion and the wear plates and grates, a fastening assembly for securing the grates and wear plates in mutual pressing relation with the discharge channel members comprising a plurality of rigid cantilever post means each having a body portion and a securing stem portion that adjoins the body portion at one end thereof and is secured in fixed relation to the discharge head portion whereby the body portion provides a transverse load bearing capability for supporting towards the other end thereof one or more of the grates and wear plates.

In accordance with yet another aspect of the invention there is provided in a grinding mill hollow drum structure having a discharge head portion, a liner plate member, a plurality of discharge grates and wear plates, and a plurality of discharge lifters located between the liner plate member and the grates or wear plates for elevating ground material passing through the grates from the periphery of the structure toward the center of the structure to be discharged therefrom a fastening assembly for securing each of the discharge lifters in position between the grates or the wear plates and the liner plate member and for securing the grates and wear plates in mutual pressing relation with the discharge channel members. The fastening assembly comprises hollow, rigid cantilever post means each having a body portion and a securing stem which adjoins the body portion at one end thereof and passes through aligned apertures in the liner plate member and the discharge head portion so as to protrude from the discharge head portion. The stem portion has a securing nut that is accessible from outside the drum structure for releasably securing the cantilever post means in fixed relation to the discharge head portion. When the cantilever post means is secured in fixed relation to the discharge head portion, it provides a transverse load bearing capability for the body portion to support one of the discharge lifters and to support towards the other end thereof one or more of the wear plates and grates. The fastening assembly further comprises retaining means surrounding the body portion and cooperating with the one discharge lifter to hold the one discharge lifter in secured relation to the body portion, and an inner bolt means being withdrawable through the hollow cantilever post means and having a tensioning nut accessible from outside the drum structure for tensioning the inner bolt means to hold the grates and wear plates in mutual pressing relation with the one discharge lifter, the cantilever post means substantially precluding transverse movement of the inner bolt means.

The significance of the transverse load bearing capability of the cantilever post means is three-fold. Firstly, the transverse load bearing capability permits the post means to support the discharge lifter during vertical assembly of the drum structure at the job site which results in easier erection thereof. Secondly, the transverse load bearing capability of the post means and the inherent rigidity of the post means restrict or substantially precludes the transverse "working" movement of the inner bolt means within the post means which reduces or even eliminates the degree of grate section movement caused by the loosening that the inner bolt means undergoes during the operation of the mill. Thirdly, the transverse load bearing capability of the post means permits the discharge lifter structure to be only comprised of abrasive resistant material.

The retaining means of the fastening assembly in one construction of the invention may comprise a boss formed integrally with the discharge lifter and having an aperture therethrough. Once the cantilever post means is secured in fixed relation with the aligned apertures, retaining means of this construction permits the discharge lifters to be easily slid over the post means to be rested thereon. In another construction, the retaining means may comprise an outrider member that surrounds a portion of the body of the post means and is secured to the discharge lifter by a suitable clamp means. When the outrider member is of this other construction, the discharge lifter may rest on the cantilevered post supported against the force of gravity while the outrider means are clamped in place to secure the discharge lifter in fixed relation to the cantilever post means.

For a better understanding of the nature and objects of the invention reference may be had, by way of example to the accompanying diagrammatic drawings in which:

FIG. 1 is a diametral sectional view of a hollow drum grinding mill structure according to the present invention;

FIG. 2 is a pictorial view of the discharge zone of the mill shown pre-assembled horizontally on the ground;

FIG. 6 is a sectional view of another alternate embodiment to the preferred embodiment of FIG. 4; and, FIG. 6A is a sectional view of the fastening assembly seen along line 6A—6A of FIG. 6.

Figure 3:
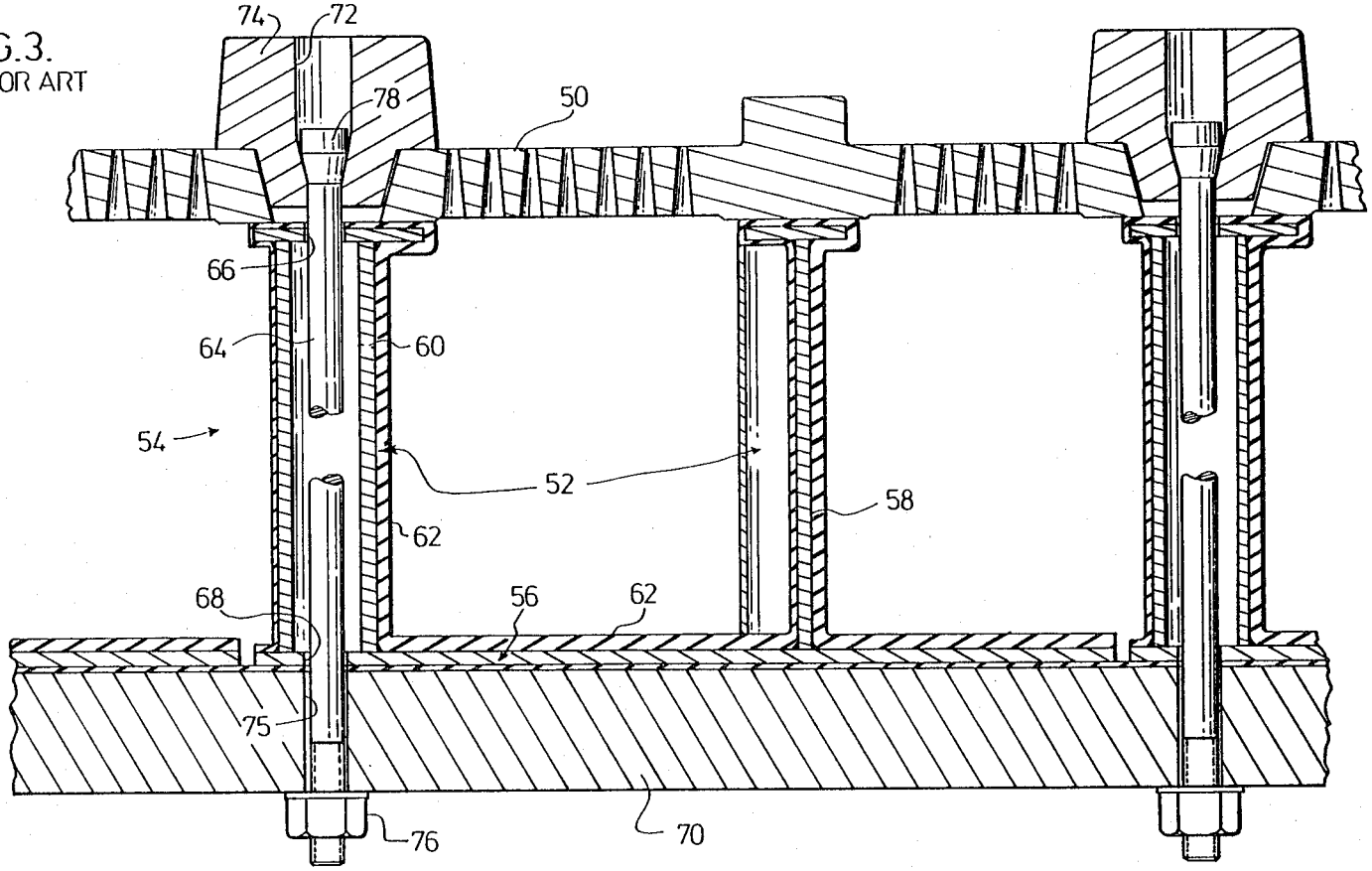
FIG. 3. PRIOR ART
FIG. 3 is a side sectional view of a prior art fastening assembly suitable for use in the discharge zone as would be seen along section A-A of FIG. 1.

Referring now to FIG. 1, the mill structure 10, shown in diametrical section, is mounted for rotation about a horizontal axis, having hollow trunnions at the structure ends 12, 14 for respectively charging and discharging the mill, in known fashion.

In FIGS. 1 and 2, a discharge zone 16 is shown to include a plurality of discharge channel members or lifters 18 that are secured, in a manner to be later described, to a discharge head portion or member 20. A liner plate member 24, which is welded to box-like lifters 18, protects head member 20 from ground material in drum structure 10 as is well known in the art. The discharge lifters 18 closer to the periphery 30 of drum structure 10 are shown interpositioned between a plurality of grates or grated sections 26 and liner plate member 24.

During the operation of drum structure 10, friable material in the interior zone 28 is ground into a pulp or ground material. The ground material having a particle size smaller than the openings in grates 26, passes through the openings in grates 26 to be elevated by discharge lifters 18 from the drum periphery 30 towards the center 32 of drum structure 10 for discharge therefrom.

Wedges or clamp members 36, extending between pairs of grates 26, hold the grates 26 against the discharge lifters 18 in mutual pressing relation therewith and they hold the discharge lifters 18 in mutual pressing relation with liner plate member 24 of discharge head portion 20. Additional wedges or clamp members 38, shown in FIG. 1, hold the wear plates 27 against the discharge lifters 18 that are located in proximity to the center 32 in mutual pressing relation with the liner plate member 24. Also, wedges 36, 38 in conjunction with lifters 40 (FIG. 2) elevate grinding balls and larger friable material above the pulp in the interior 28 so that the grinding balls and larger friable material may further reduce the size of the pulp or ground material.

Figure 4:
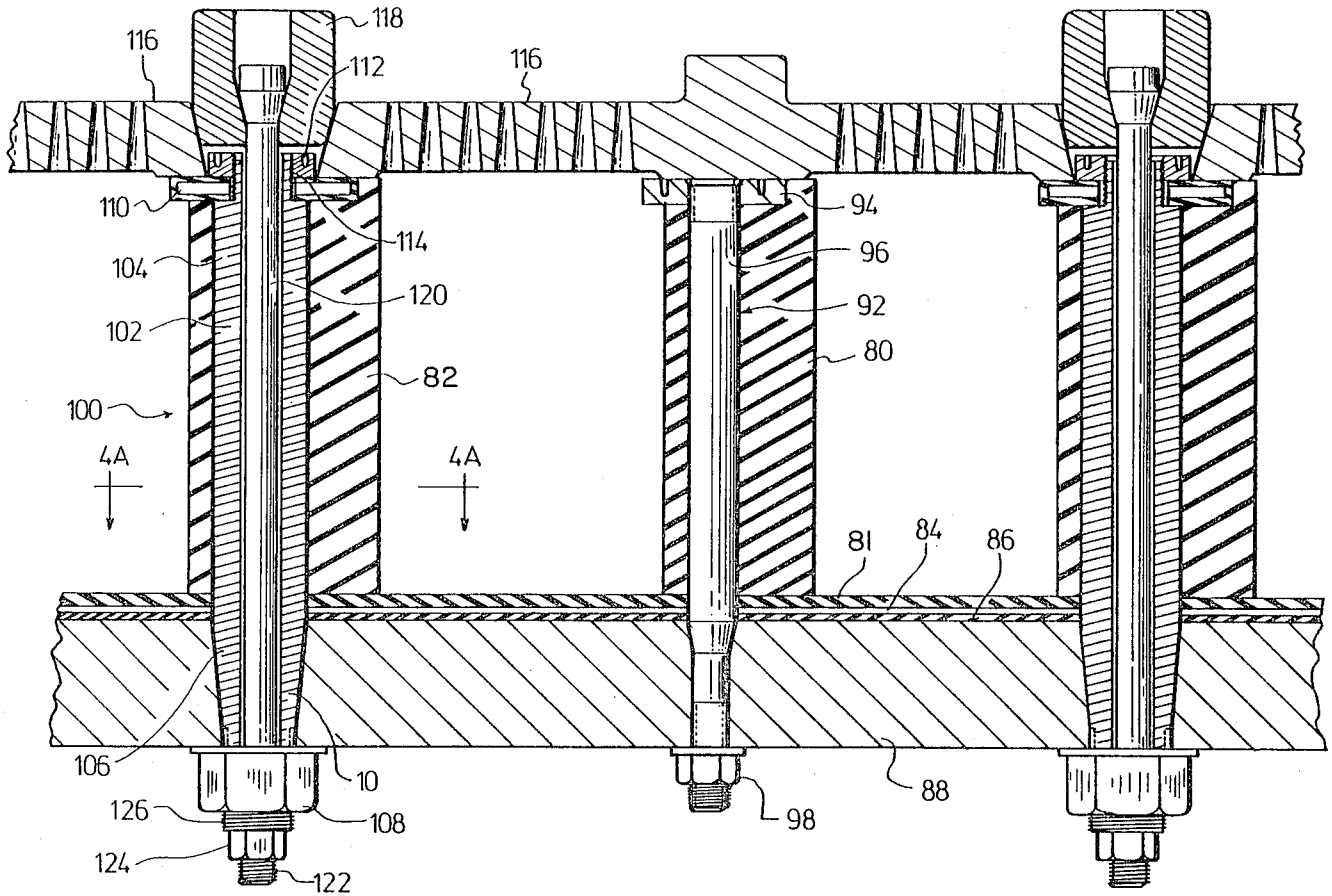
FIG. 4 is a side sectional view of the preferred embodiment for the fastening assembly of the present invention as would be seen along section A-A of FIG. 1.
Figure 5:
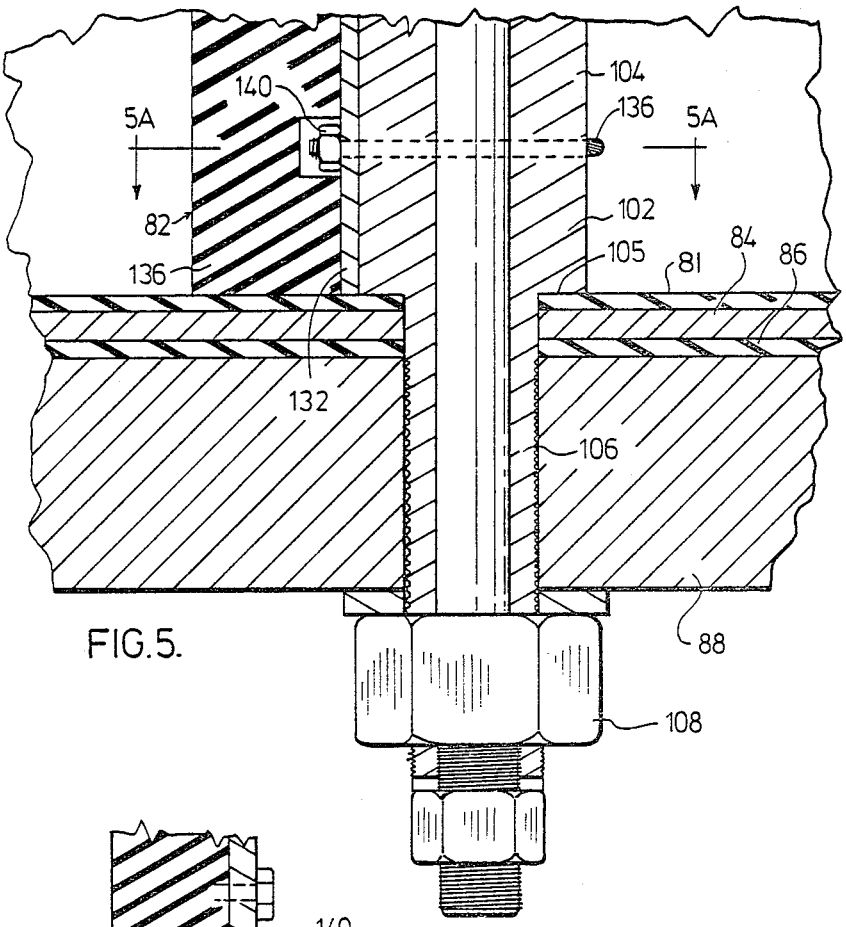
FIG. 5 is a sectional view of an alternate embodiment to the preferred embodiment of FIG. 4.

FIGS. 3 through 6 show different fastening assemblies each of which can be employed to hold wedges 36, 38 against discharge lifters 18. The fastening assembly of FIG. 3 is the prior art arrangement previously discussed. The fastening assemblies of FIG. 4 shows the preferred embodiment of the present invention while FIGS. 5 and 6 depict alternate embodiments to the preferred embodiment.

Referring now to FIG. 3, a prior art fastening assembly suitable for use in a mill structure of FIG. 1 is shown. Grates 50 are held in mutual pressing relation with weldment 52 by means of assembly 54. Weldment 52 comprises a metal liner plate 56 having a metal support discharge lifter 58 and metal hollow box-like discharge lifter 60 welded thereto. Weldment 52 is covered with a thick rubber material 62 which protects weldment 52 from abrasive materials. Although not shown in FIG. 3, weldment 52 is bolted to discharge head portion 70. Fastening assembly 54 comprises a long bolt 64 passing through openings 66, 68 in lifter 60. Bolt 64 passes through recessed opening 72 in clamp member 74, hole 66, the interior of hollow lifter 60, hole 68 and aperture 75 in discharge head portion 70. When nut 76 is tightened, head 78 of bolt 64 draws clamp member 74 against grates 50, which in turn draws grates 50 against lifters 58, 60. It should be understood that for each lifter 60 there are usually two bolts 64 passing therethrough. One disadvantage with fastening assembly 54 is that during the job site assembly grates 50 and wedges or clamps 74 have to be supported while bolt 64 is inserted. The problem faced here is that it is often quite difficult to align bolt 64 in the hollow discharge lifter 60 with opening 68. Another disadvantage with fastening assembly 54 is that during mill operation the transverse "working" movement of bolt 52 due to loading of clamp 74 thereon has been known to elongate opening 66 which results in working of grate sections 50 causing them to be radially displaced. In some instances grinding balls of 3 inches in diameter have passed between worked grate sections 50. Another disadvantage with the assembly 54 is that shortly after abrasive materials wear through rubber 62 and metal lifter structure 60 the bolt 64 becomes abraded and fails.

Figure 4A:
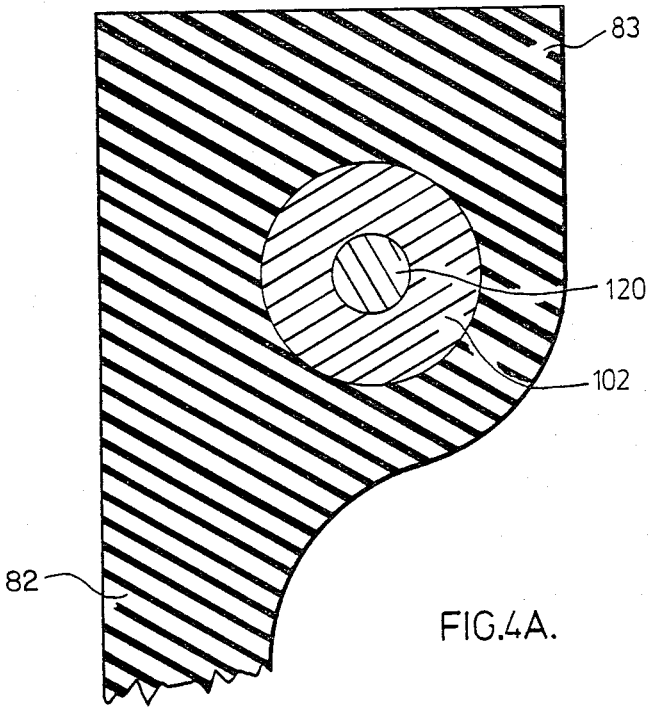
FIG. 4A is a sectional view of the fastening assembly of the preferred embodiment seen along section 4A—4A of FIG. 4.

Referring now to FIGS. 4 and 4A the preferred embodiment for the fastening assembly of the present invention will now be described. In this embodiment discharge lifter 82 and support discharge lifter 80 are shown to be mutually exclusive. Support lifter 80 and lifter 82, as shown, comprise an abrasive resistant material such as, for example, a rubber-like material. Support lifter 80 is held in pressing relation against abrasive resistant liner member 82, liner plate 84, abrasive resistant member 86 and discharge head portion 88 by assembly 92. Assembly 92 comprises a washer or flange 94 secured to bolt 96. Bolt 96 is held in position by tightening of nut 98. The preferred embodiment for the fastening assembly of the present invention is shown at 100. Fastening assembly 100 comprises a rigid hollow cantilever post means or more simply post 102 having a body portion 104 and a conical securing stem portion 106 adjoining one end of the body portion 104. The securing stem portion 106 protrudes from head portion 88 and is accessible from outside the mill structure for releasably securing post 102 in fixed relation to discharge head portion 88 by means of nut 108 which is tightened against head portion 88. Post 102 is shown, in the preferred embodiment, to pass through a boss portion 83 of lifter 82 (see FIG. 4A). By forming the boss 83 as an integral part of the lifter 82, less abrasive resistant material is used for the lifter and a cost savings is realized. When the stem portion 106 of post 102 is secured in fixed relation to head portion 88, the body portion 104 provides a transverse load bearing capability for supporting discharge lifter 82. In the preferred embodiment the assembly is provided with a washer 110 coated with an abrasive resistant material and held in place by hollow nut 112 passes over threads 114. The washer nut combination acts as a retaining means to hold lifter 82 in mutual pressing relation with head portion 33. Washer 110 also provides a surface onto which grate sections or grates 116 are held by wedge 118. It should be understood that instead of using wedge 118 a clamp similar to clamp 74 of FIG. 3 could be used. Inner bolt means or elongated bolt 120 is withdrawable through post 102 and has a tensioning portion 122 accessible from outside the mill structure for tightening bolt 120 by moving nut 24 up against end portion 126 of post 102. When tightened, bolt 120 causes wedge 118 to hold grates 116 against washer 110 and lifter 82. Wedges 118 produce a transverse load on bolt 120 which is countered by the transverse load bearing capability of post 102 so as to substantially preclude bolt 120 from moving transversely. Thus it may be said that the body portion 104 of post 102 provides a transverse load bearing capability towards its other end (opposite end to which stem 106 is joined) for supporting the grates 116. It should be noted that although grates are shown the foregoing is also applicable to wear plates 27 (see FIG. 1).

One significant feature of the fastening assembly 100 is, that once the cantilever post 102 is secured in fixed relation to the discharge head portion 88, the body portion 104 has a transverse load bearing capability. This is primarily due to there being no gap between the steam portion 106 and aligned apertures in the liner plate members 82, 84, 86 and head portion 88, the rigidity of the post 102, and the manner in which the post 102 is secured in fixed relation to head portion 88. The transverse load bearing capability of the post 102 permits the discharge lifter 82 to be supported by the cantilever posts 102 with there being preferably two posts for each discharge lifter. Once the discharge lifter is placed on the posts, the washer 110 and nut 112 may be secured in place as shown. Thus, only the wedge 118 and grates 116 need be supported when the inner bolt means 120 is easily passed through the post 102. Another significant feature lies in the fact that the post 102 substantially precludes any transverse "working" movement of inner bolt means 120 during the operation of the drum structure and as a result the fastening assembly 100 does not permit the movement of the grates 116 in the direction of larger diameters and larger circumferences. Another significant feature is that the metallic box-like structure is no longer required to form part of the discharge lifter since the lifter is comprised of abrasive resistance material.

Figure 5A:
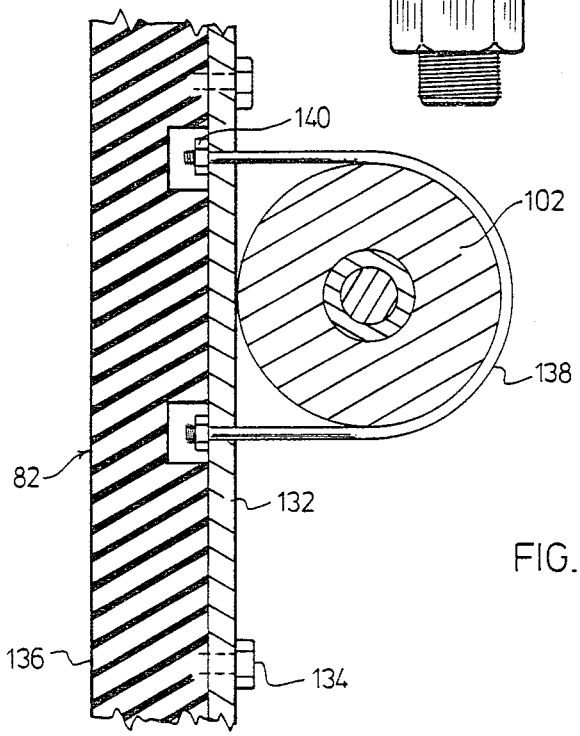
FIG. 5A is a sectional view of the fastening assembly seen along section 5A—5A of FIG. 5.

Referring now to FIG. 5 an alternate embodiment for the fastening assembly is shown. In this embodiment a shoulder 105 is formed where body portion 104 meets stem portion 106. Shoulder 105 holds the liner plate member including material 82, plate 84 and material 86 in mutual pressing relation against discharge head portion 88. In this embodiment stem portion 106 is not conical and is held under tension by nut 108. Although nut 108 is employed in this embodiment it is contemplated that in other embodiments no such nut could be used and stem 106 could be rotated into a threaded aperture in head portion 88. The retaining means in FIG. 5 and 5A is also of a different construction. Lifter 82 is shown to comprise metal plate 132 bolted by rubber bolts 134 onto abrasive resistant material 136. This will permit the use of a retaining means comprising outrider members such as U-shaped bolts 138 surrounding a portion of the body portion 104. Bolts 138 may be secured to lifter 82 by means of nuts 140.

Referring now to FIGS. 6 and 6A the outrider members of the retaining means are shown to include outrider members, such as rubber U-shaped member 150 surrounding a portion of post 102 and secured to lifter 82 by rubber bolts 152. In this embodiment stem 106 is shown threaded into head portion 88.

It should be understood that any spacial gap between stem portion 106 and the aligned apertures in the liner plate member and discharge head portion may be filled with a filler "sealtite" TM during the final assembly of the drum structure.

It should also be understood that the cantilever post in an alternate embodiment may comprise an outer pipe and an inner pipe shrink fitted together where the outer pipe comprises the body portion and the inner pipe extending below the body portion comprises the stem portion.

In a particular alternate embodiment the U-shaped member 150 of FIGS. 6 and 6A may surround a major portion of the post 102.

It should be understood that alternate embodiments for the invention may be readily apparent to a man skilled in the art in light of this disclosure. Accordingly, the invention should be limited only to that which is claimed in the accompanying claims.

What I claim as new and desire to secure by Letters Patent of the United States is:

1. In a grinding mill hollow drum structure having a discharge head portion, and a plurality of discharge channel members, a fastening assembly for securing each of said discharge channel members to said discharge head portion, comprising at least one rigid cantilever post means having a body portion and a securing stem portion that adjoins the body portion at one end thereof, said securing stem portion being mechanically releasably secured in fixed relation to said discharge head portion independently of said channel members whereby said body portion of each said posts provides a transverse cantilevered load bearing capability for supporting one of said discharge channel members.

2. The drum structure of claim 1 wherein the fastening assembly further includes retaining means cooperating with said one discharge channel member and said body portion to retain said one discharge channel member in secured relation to the body portion.

3. The structure of claim 2 wherein said retaining means includes outrider members extending from said one discharge channel member to surround a portion of said body portion.

4. The structure of claim 3 wherein each of said outrider members comprises a U-bolt, and said one discharge channel member having apertures therein for receiving end portions of said U-bolt.

5. The structure of claim 3 wherein each of said outrider members comprises a U-shaped rubber bracket having flange portions bolted to said discharge channel member.

6. The structure of claim 2 wherein said retaining means comprises a boss forming an integral portion of said one discharge channel member, said boss having an aperture therein through which the body portion passes.

7. The structure of claim 1 wherein said securing stem portion protrudes from said discharge head portion and is accessible from outside said structure to releasably secure said cantilever post means to said discharge head portion.

8. The structure of claim 1 further having a plurality of grates and wherein said rigid cantilever post means is hollow, said fastening assembly further includes an inner bolt means passing through the hollow cantilever post means and having a tensioning nut accessible from outside the drum structure for tensioning the inner bolt means to hold said grates in mutual pressing relation with said one discharge channel member, said hollow cantilever post means substantially precluding transverse movement of said inner bolt means.

9. The structure of claim 1 wherein there are at least two cantilever post means for each discharge channel member.

10. In a grinding mill hollow drum structure having a discharge head portion, a plurality of wear plates and grates, and a plurality of discharge discharge channel members interpositioned between said discharge head portion and said wear plates and grates, a fastening assembly for securing said grates and wear plates in mutually pressing relation with said discharge channel members comprising a plurality of rigid cantilever post means each having a body portion and a securing stem portion that adjoins the body portion at one end thereof and being mechanically releasably secured in fixed relation to said discharge head portion independently of said channel members whereby said body portion is mounted in cantilever relation to said discharge head portion and provides a load bearing capability for supporting towards the other end thereof one or more of said grates and wear plates.

11. The structure of claim 10 wherein each of said cantilever post means is hollow and has inner bolt means extending therethrough, said inner bolt means having a tensioning nut accessible from outside the drum structure for tensioning the inner bolt means to hold one of said grates or wear plates in mutual pressing relation with one of said discharge channel members, each of said hollow cantilever post means substantially precluding transverse movement of said inner bolt means.

12. The structure of claim 11 wherein said fastening assembly further includes clamping means through which said inner bolt means passes to draw said clamping means against said grates and wear plates.

13. The structure of claim 12 wherein said securing stem portion protrudes from outside said structure to releasably secure said cantilever post means to said discharge head portion.

14. In a grinding mill hollow drum structure having a discharge head portion, a liner plate member, a plurality of discharge grates and wear plates, and a plurality of discharge lifters located between said liner plate member and said grates or wear plates for elevating ground material passing through the grates from the periphery of the structure toward the center of the structure to be discharged therefrom, a fastening assembly securing said discharge lifters in position between said grates or said wear plates and said liner plate member and for securing said grates and wear plates in mutual pressing relation with said discharge channel members, comprising hollow, rigid cantilever post means each having a body portion and a securing stem portion which adjoins the body portion at one end thereof and passes through aligned apertures in said liner plate member and discharge head portion so as to protrude from the discharge head portion, said stem portion having a securing nut that is accessible from outside the drum structure for releasably securing said cantilever post means in fixed relation to said discharge head portion, said cantilever post means secured in fixed relation to the discharge head portion independently of said lifters providing a transverse load bearing capability for said body portion to support one of said discharge lifters and to support towards the other end thereof one or more of said wear plates and grates, retaining means surrounding the body portion and cooperating with said one discharge lifter for holding said one discharge lifter in secured relation to the body portion, and an inner bolt means passing through the holler cantilever post means and having tensioning nut accessible from outside the drum structure for tensioning the inner bolt means to hold said grates and said wear plates in mutual pressing relation with said one discharge lifter, said cantilever post means substantially precluding transverse movement of said inner bolt means.

15. The structure of claim 14 wherein said cantilever post means has a shoulder portion where said body portion adjoins said securing stem portion, said shoulder portion holding said liner plate member in mutual pressing relation with said discharge head member.

16. The structure of claim 14 wherein said securing stem portion has a conical shape.

17. The structure of claim 14 wherein the retaining means includes a flange secured to the other end of the body portion which overlaps a recessed portion of said discharge lifter and holds said lifter in pressing relation against said liner plate member whereby said liner plate member is held in mutual pressing relation with said discharge head member.

18. The structure of claim 14 wherein said retaining means further includes U-shaped outrider members each surrounding a portion of said body portion and having their ends secured to said one discharge lifter.

19. The structure of claim 17 wherein said retaining means further includes a boss forming an integral portion of said one discharge lifter, said boss having an aperture therein through which the body portion passes.

20. A structure as claimed in claims 1, 7 or 10 wherein at least some of said discharge channel members are formed predominately of abrasive resistant rubber.

21. Structure as defined in claim 14 wherein at least some of said discharge lifters are formed primarily of abrasive resistant rubber.

* * * * *